US005383252A

United States Patent [19]

Hampton et al.

[11] Patent Number: 5,383,252

[45] Date of Patent: Jan. 24, 1995

[54] VACUUM CLEANER WITH IMPROVED ASSEMBLY

[75] Inventors: Leonard B. Hampton; Vincent L. Bobrosky; Paul J. Burress, all of Normal; Hollis Spence, Bloomington, all of Ill.

[73] Assignee: White Consolidated Industries, Inc., Cleveland, Ohio

[21] Appl. No.: 182,339

[22] Filed: Jan. 18, 1994

Related U.S. Application Data

[62] Division of Ser. No. 962,412, Oct. 16, 1992, Pat. No. 5,309,601.

[51] Int. Cl.[6] ..... A47L 9/00

[52] U.S. Cl. ..... 15/325

[58] Field of Search ..... 15/377, 325

[56] References Cited

U.S. PATENT DOCUMENTS

| | | | |
|---|---|---|---|
| 2,648,090 | 8/1953 | Howard | 15/325 |
| 2,682,682 | 7/1954 | Lewyt et al. | 15/325 X |
| 4,305,176 | 12/1981 | Lessig et al. | 15/325 |
| 4,397,058 | 8/1983 | Koland | 15/325 |
| 4,447,930 | 5/1984 | Glenn et al. | 15/377 X |
| 5,054,156 | 10/1991 | Watanabe et al. | 15/377 X |

*Primary Examiner*—Chris K. Moore

*Attorney, Agent, or Firm*—Pearne, Gordon, McCoy & Granger

[57] ABSTRACT

The present invention relates to an upright vacuum cleaner having an improved assembly to optimize the assembly and operational characteristics of the vacuum cleaner. The floor engaging unit of the vacuum cleaner has a two-piece body including a base and a hood which are snap-fit together. A motor is rotatably mounted within the body at the end of a handle assembly. The handle assembly, which also functions as a conduit for dirty air to travel to a disposable filter bag, carries an electrical connector which connects the motor to power. The handle further provides a stop which engages a hose hook that slidably fits over the top of the handle, the stop being located such that the hose hook is properly positioned to support a hose during storage thereof. A filter bag, which is mounted to the handle at a location downwardly spaced from the top of the filter bag, is provided with a wire frame to help support the weight of the disposable filter bag. The motor is provided with a foot switch actuator assembly that allows actuation of the motor switch regardless of the radial position of the motor switch. A brush roller, which is rotatably driven by the motor, includes a pair of mounting end caps. The end caps include outwardly extending projections which are received by the base, releasably mounting the roller thereto. The invention reduces the time, labor and material required to manufacture and assemble an upright vacuum cleaner.

2 Claims, 4 Drawing Sheets

VACUUM CLEANER WITH IMPROVED ASSEMBLY

This is a division of application Ser. No. 07/962,412, filed Oct. 16, 1992, now U.S. Pat. No. 5,309,601, issued May 10, 1994.

BACKGROUND OF THE INVENTION

1. Field of the Invention

The present invention relates generally to vacuum cleaners, and, more particularly, to upright vacuum cleaners with improved operational and assembly features.

2. Description of the Related Art

During the development of upright vacuum cleaners, several manufacturing or assembly techniques have become common. These common assembly techniques, which are typically related to equally common structural features of the upright vacuum cleaner, tend to be inefficient and result in higher assembly costs and, ultimately, increase the cost of the resulting vacuum cleaner.

As shown by U.S. Pat. No. 4,648,149, which issued on Mar. 10, 1987, and is owned by the assignee of the present invention, the ground engaging member of an upright vacuum cleaner generally comprises three pieces, the bottom plate, the base and the hood. A number of independent fasteners are required to attach these pieces together, resulting in a lengthy assembly time. Moreover, maintenance or repair on the interior of the ground engaging member requires at least partial disassembly, which is typically difficult for the average user to perform. Also, a separate bumper or furniture guard is typically attached to the front edge of the hood.

Another common feature of upright vacuum cleaners, as embodied by the '149 patent, is the provision of a rotatable brush being mounted on the frame of the ground engaging unit. The rotatable brush is provided with end caps which, in turn, are mounted within resilient mounting caps. The resilient mounting caps are shaped to fit corresponding recesses in the frame. Other rotatable brushes known in the art include end caps which are mounted to the frame by means of conventional fasteners. A separate gasket or sealing member is placed between the base and the bottom plate, generally surrounding the rotatable brush to seal the housing and prevent the escape of suction except for the aperture below the brush.

Another typical feature of upright vacuum cleaners, as shown by the '149 patent, is a vacuum bag cover which houses the disposable vacuum bag. The vacuum bag cover is mounted or attached along a top surface thereof to the vacuum cleaner handle. A bag retainer extends between the top surface of the bag cover and the handle, holding the bag cover in place thereon. Other well known vacuum bag cover mounting assemblies include having a spring extend between the top of the bag cover and the handle. Mounting of the vacuum bag cover in this manner results in an extra assembly step, as well as the added expense of additional parts.

Another type of vacuum bag cover known in the art is shown by U.S. Pat. No. 4,566,884, which issued on Jan. 28, 1986. The '884 patent teaches a vacuum cleaner bag supporting structure which includes a bag support extending outwardly from the handle, a bag top support which is mounted to the bag support on the interior of the vacuum cleaner bag, and a bag top, which is mounted externally of the vacuum cleaner bag. The bag top provides a pair of mounting pins which extend through mounting apertures provided by the cleaner bag and the bag top support. The bag support receives a spring and a downwardly extending post from the bag top support and thereby supports the weight of the vacuum cleaner bag.

Another common feature of upright vacuums shown by the '149 patent involves having the motor rigidly mounted within or attached to the ground engaging unit. The motor includes a shaft which, via a pulley and a drive belt, drives the rotatable brush. A fan or impeller is mounted on the motor shaft above the drive belt to draw air from the vicinity of the rotatable brush and transmit same to the disposable vacuum bag via a conduit. Mounting of the motor in this fashion requires several conventional fasteners, in addition to the time required to assemble the conduit and connect the drive belt between the shaft and the brush. Furthermore, extra wiring is generally necessary to supply power to the motor, resulting in added assembly and material costs.

Another common feature of upright vacuum cleaners is the provision of a cord or hose retaining hook on the handle which engages the electrical power cord or the accessory hose to aid in support and storage thereof. One common form of hose hook provides a pair of clamping jaw members which clampingly engage the handle with the aid of a series of fasteners. An alternative hose hook resiliently snap-fits onto the handle, having a pair of arms which engage opposite sides of the handle to resist removal of the hose hook therefrom. Hose hooks of these types suffer from the disadvantage of either requiring extra fasteners for attachment to the handle, in the case of clampingly mounted ones, or of being awkward and difficult to attach to the handle, in the case of snap-fit ones.

Therefore, there exists a need in the art for an improved vacuum cleaner assembly which removes at least some of the disadvantages common in the art.

SUMMARY OF THE INVENTION

The present invention is directed towards several important features which improve assembly and operational characteristics of an upright vacuum cleaner. One of the important features of the present invention is the provision of a two piece floor engaging unit comprising a base and a hood, eliminating the bottom plate which is conventional in the art. A series of resilient arms extend between the hood and base, and snap-fit into apertures. The resilient arms are deformable, allowing the hood and base to be separated when access to the interior of the floor engaging unit is desired.

Another important feature is embodied by the motor being attachable to the end of the vacuum handle, and rotatably mounted within the floor engaging unit of the vacuum cleaner. The motor is connected by a standard electrical connector to an electrical cord which is carried by the handle, no extra wiring being necessary.

Another feature of the present invention is the provision of a foot switch actuator assembly that allows actuation of the motor switch regardless of the position of the switch provided by the motor. The foot switch actuator provides an actuating surface which engages the switch regardless of the switch position, which will vary due to rotation of the motor via the handle.

Another important feature of the present invention is a cord or hose hook that slidably fits over the top of the handle. The hose hook is provided to support an attachment hose during storage on the vacuum cleaner. A stop is provided by the handle to properly position the hose hook on the handle to receive the hose.

The present invention also includes the feature of having the rotatable brush mounted to the base of the ground engaging unit of the vacuum cleaner. The brush includes a pair of brush mounting end caps, each of which provide outwardly directed projections. The projections are received by openings in the base to mount the rotatable brush thereto.

Another important feature of the present invention is the provision of a vacuum bag cover mounting device that mounts on the handle at a location downwardly spaced from the top of the vacuum bag cover, rather than at the top of the bag cover, as is conventional in the art. The mounting device includes an internal wire frame to vertically support the bag cover and the enclosed disposable vacuum bag.

The present invention also has the feature of a combined elastomeric bumper or furniture guard and sealing gasket. The combined bumper and sealing gasket cushions the front of the hood, while sealing a portion of the union of the base and the hood, preventing the escape of suction through the intersection of the hood and base.

Another important feature of the present invention is the provision of a suction channel intermediate the rotatable brush and the motor. Dirt-laden air is drawn from the floor beneath the brush, through the suction channel, motor, and handle, and into a removable bag housed within the vacuum cleaner bag cover. The suction channel comprises an integrally molded section of the base and an ultrasonically welded top panel, advantageously forming and sealing the suction channel without the need for independent fasteners or gaskets. The top panel includes an upwardly-directed opening to accommodate the attachment of an accessory wand connector.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
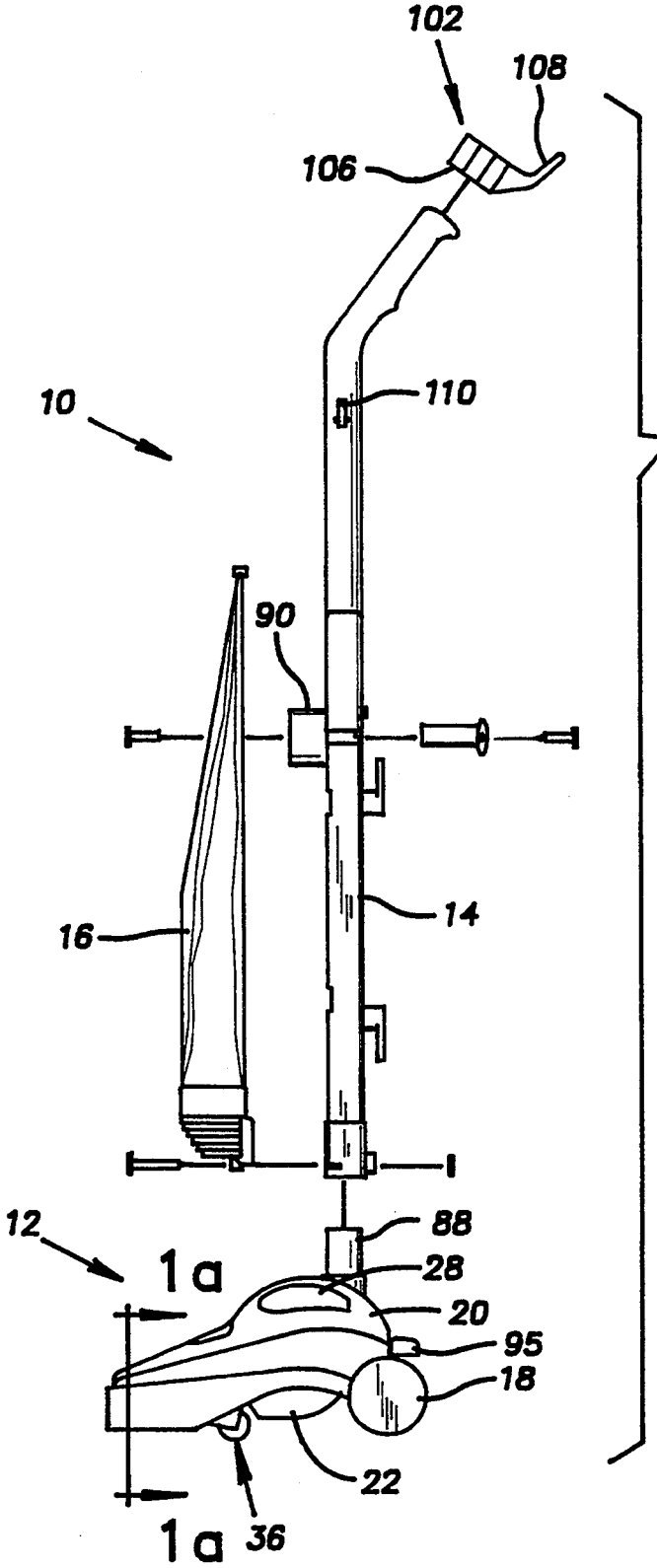
FIG. 1 is an exploded side elevational view of an upright vacuum cleaner in accordance with the present invention.

With reference to FIG. 1, an upright vacuum cleaner 10 produced in accordance with the present invention is shown. The vacuum cleaner generally includes a floor engaging unit 12, a handle 14 and a vacuum bag cover 16.

Figure 2:
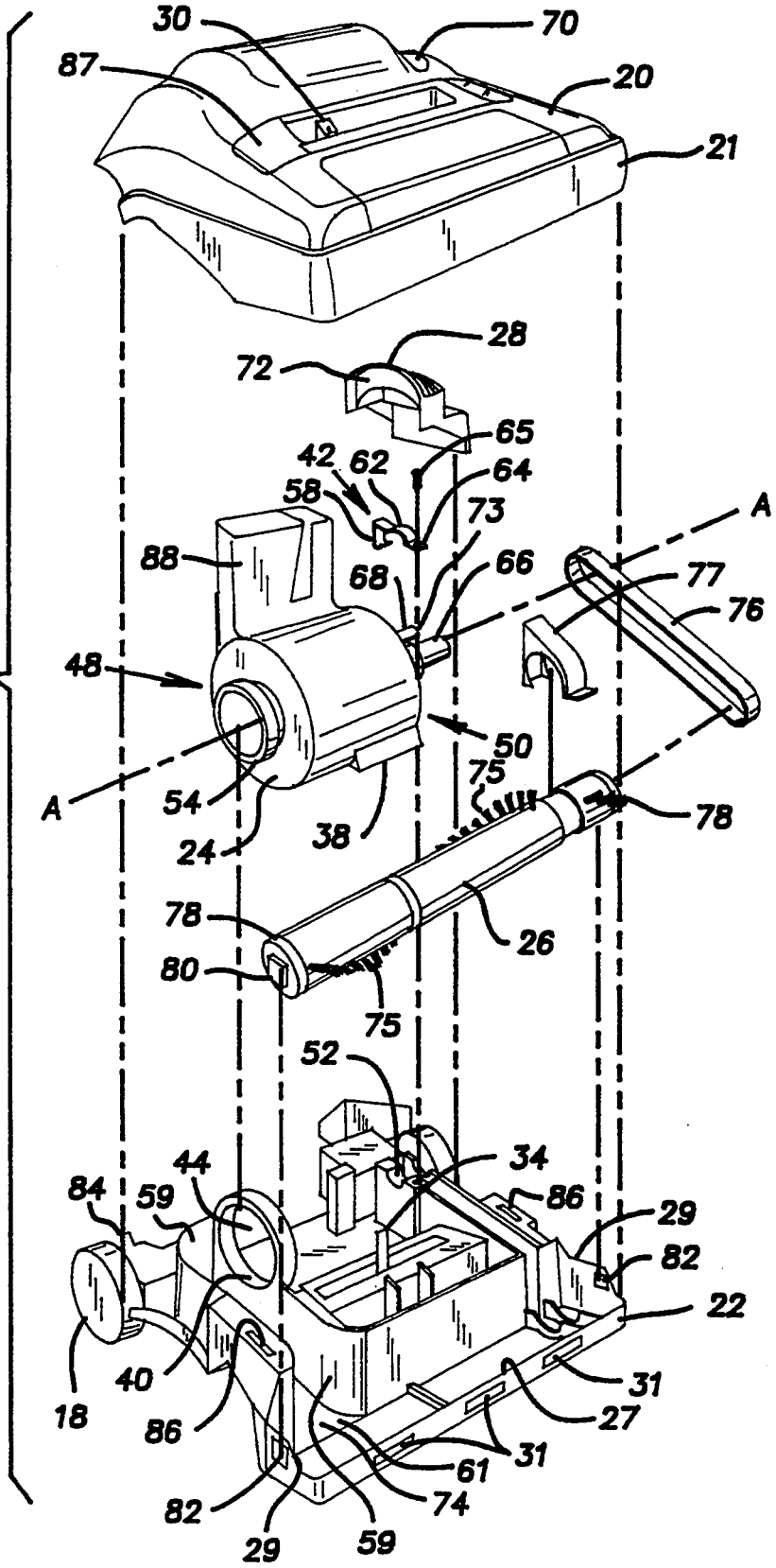
FIG. 2 is an exploded perspective view of the floor engaging unit of the present invention.
Figure 3:
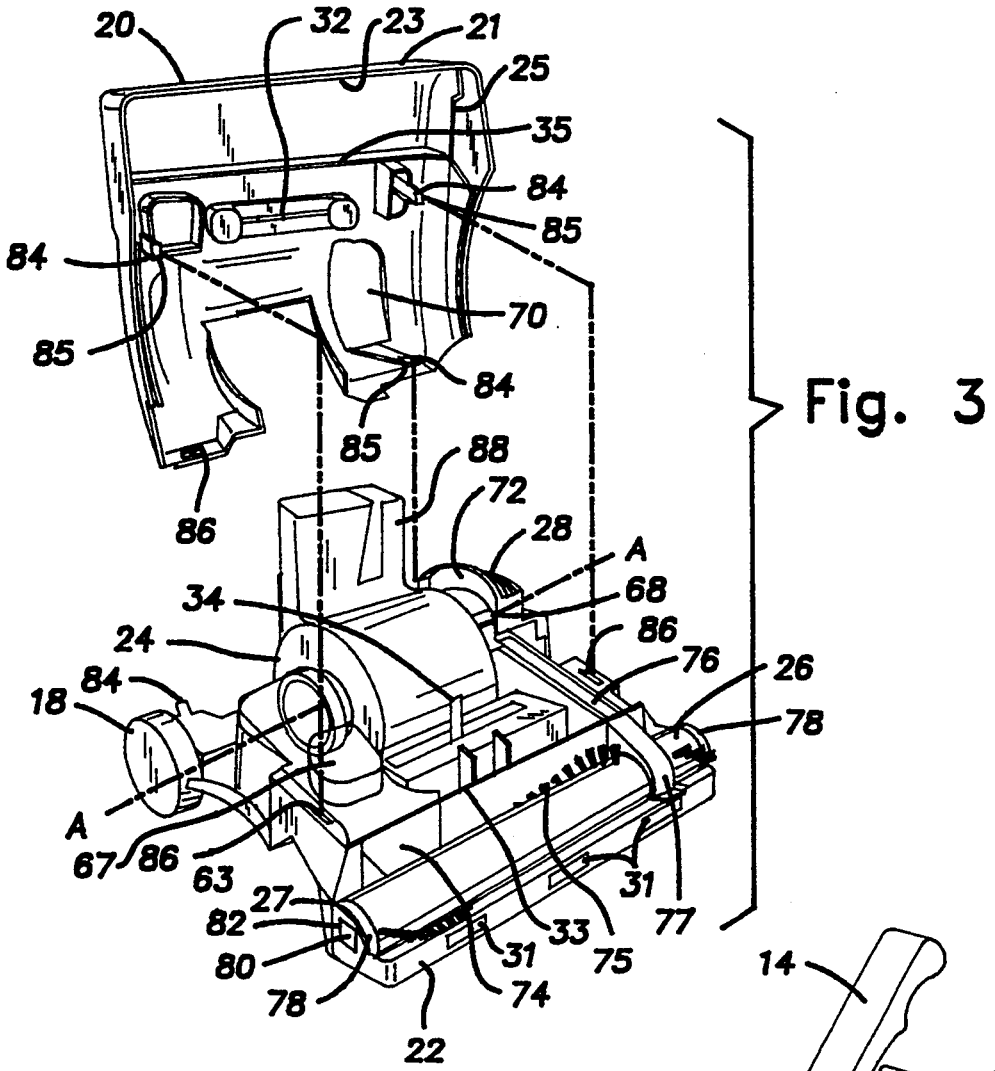
FIG. 3 is a perspective view of the floor engaging unit of the present invention, with the hood removed and inverted.
Figure 1A:
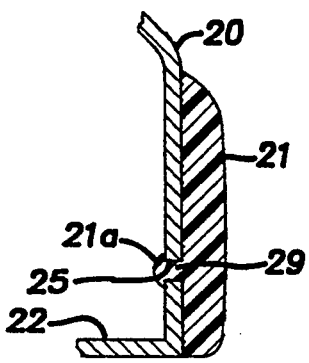
FIG. 1*a* is an enlarged fragmentary view, the plane of the view being indicated by the line 1*a*–1*a* in FIG. 1.
Figure 5:
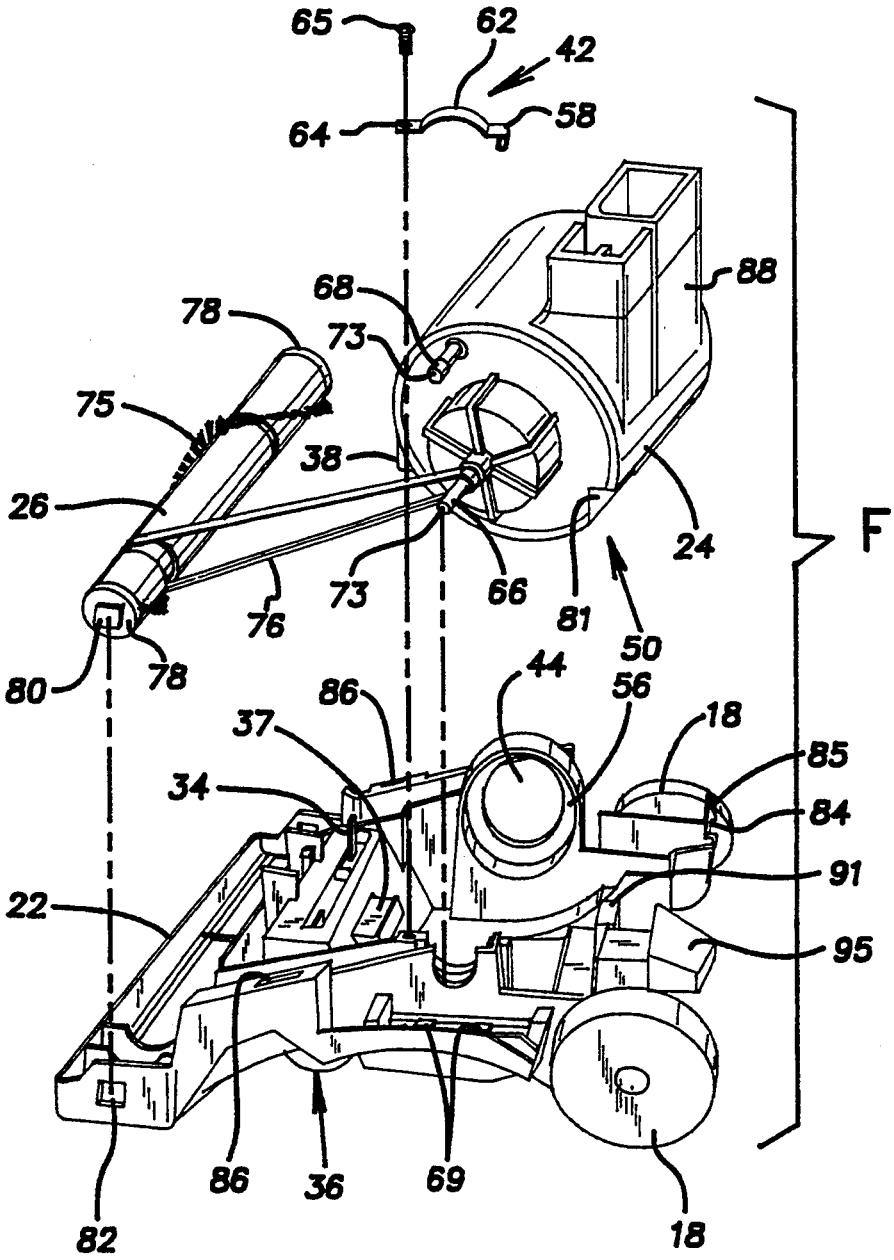
FIG. 5 is a partial exploded perspective view of the base of the floor engaging unit of the present invention.

As shown best in FIGS. 2, 3, and 5, the floor engaging unit 12 is provided with a pair of rearwardly located snap-on wheels 18, a hood 20, a base 22, a rotatably mounted motor 24, a rotary brush 26, a foot switch actuator 28, and a height adjustment mechanism 30. The wheels 18 snap fit into apertures (not shown) provided by the base 22 of the floor engaging unit 12.

The height adjustment mechanism 30 is slidably attached to the hood 20, and provides an upwardly extending notch 32 on the underside thereof to receive an upstanding rod 34 from the base 22. An opposite end of the rod 34 engages a camming surface (not shown) associated with a height adjustment means 36 whereby lateral or sliding movement of the height adjustment mechanism 30, and hence the upstanding rod 34, engages the camming surface and causes the height adjustment means 36 to move relatively vertically, altering the vertical position of the rotary brush 26 relative to the surface being cleaned.

In a like manner, the rotatably mounted motor 24 includes an outwardly extending portion 38 which engages a projection 37 of the height adjustment means 36 when the motor 24, via the handle 14, is moved into the vertical position, forcing the projection 37 and the height adjustment means 36 to move relatively away from the base 22 and increasing the distance between the rotary brush 26 and the surface being cleaned. It is desirable for the brush 26 to be spaced from the floor surface when the handle 14 is in the vertical position to prevent the brush 26 from continuously beating the same spot on the floor. Conventionally, the handle 14 is placed in the vertical position when an accessory hose is being used for off-the-floor cleaning. Naturally, engagement of the rotary brush 26 with the floor is unnecessary and undesirable during off-the-floor cleaning.

As best shown in FIGS. 2 and 3, the rotatably mounted motor 24 is received and retained in the base 22 of the floor engaging unit 12 by means of a mounting block 40 and a mounting clip 42. The mounting block 40, which is provided by the base 22, defines a circular mounting aperture 44. The motor 24 is mounted to the base 22 by sliding the impeller end 48 of the motor into the circular mounting aperture 44, and laying the drive shaft end 50 of the motor 24 onto an inwardly curved mounting surface 52. As shown in FIG. 2, the impeller end 48 of the motor includes a ring-shaped seal 54 which is pressed against an annular surface 56 surrounding the circular mounting aperture 44 to prevent loss of suction and contamination of the area intermediate the hood 20 and base 22 with dirt-laden air.

The mounting clip 42 has a hooked first end 58 which is snapped or hooked into an aperture (not shown) provided by the base 22, an arcuate center section 62 which generally matches the contour of the motor housing adjacent the drive shaft 66, and a flat end 64 which is fastened to the base 22 by a screw 65 or other conventional fastening means. The clip 42, as attached to the base 22, relatively loosely holds the drive shaft end 50 of the motor 24, allowing the motor to freely rotate about an axis A—A defined by the motor drive shaft 66, as will be described hereafter with respect to operation of the floor engaging unit 12.

The motor 24 includes an outwardly directed switch 68 which is operated by the foot switch actuator 28. The foot switch actuator 28 is retained on the base 22 of the floor engaging unit 12 by a pair of inwardly extending tabs 69, and extends through an aperture 70 in the hood 20 to be accessible to the user of the machine. The switch actuator 28 includes a switch engaging surface 72 which contacts a terminal end 73 of the switch 68 extending out of the motor 24, regardless of the angular position of the switch relative to the motor axis A—A. Generally downward movement of the foot switch actuator 28 causes the switch engaging surface 72 to move relatively downwardly and against the terminal end 73 of the switch 68, forcing the terminal end 73 of the switch 68 to move inwardly relative to the motor 24, and thereby actuating the motor.

The impeller end 48 of the motor mounted in the circular mounting aperture 44 serves as a conduit for air drawn from the area adjacent the rotary brush 26, or an accessory cleaning device, and delivers same, via the hollow handle 14, to a disposable vacuum bag (not shown) housed within the vacuum bag cover 16. Air is drawn from the mouth of a suction channel 74 adjacent the rotary brush 26, into and through the motor 24, and into the handle 14, the seal 54 between the motor and the annular surface 56 surrounding the circular mounting aperture 44 preventing the loss of suction and release of dirty air.

The suction channel 74 is defined by a pair of sidewalls 59, a bottom wall 61, and a top panel 63. Preferably, the sidewalls 59 and bottom wall 61 are integral with the base 22, while the top panel 63 is permanently attached to the upper surface of the sidewalls 59. Most preferably, the top panel is attached to the sidewalls by ultrasonic welding or other equivalent process, such as vibration welding. Hence, the suction channel 74 between the motor 24 and the brush 26 is formed and sealed without independent fasteners or gaskets, as is necessary in the prior art. The top panel 63 includes an upwardly-directed opening 67 for the receipt of an accessory, as will be described more fully hereafter.

At the drive shaft end 50 of the motor, the rotating drive shaft 66 drives the rotary brush 26 via the drive belt 76, as is common in the art. The drive belt 76 engages the rotary brush 26 at a location inwardly spaced from each end to allow the brush bristles 75 to extend as close as possible to the sides of the base 22 for improved cleaning along walls and the like. The intersection of the brush 24 and the belt 76 is provided with a belt cover 77, as illustrated.

The rotary brush is mounted in the base 22 of the floor engaging unit 12 by means of a pair of mounting end caps 78 on the ends of the brush. Each of the end caps 78 includes an outwardly directed projection 80 which is received by an accommodating aperture 82 provided by the base 22 to releasably mount the brush 26 therein. Preferably, the projections 80 and apertures 82 have at least one flat surface and, most preferably, the projections 80 and apertures 82 are square. Naturally, the invention is not limited to the specific shape of the projections, any geometric configuration being within the scope of the present invention.

Since the base 22 is formed of a resilient material, the brush 26 is installed in the base by deforming a respective side of the base outwardly and slipping the end cap 78 of the brush 26 into position so that the outwardly directed projection 80 is received by the aperture 82 in the base. Thereafter, the procedure is repeated with respect to the other side of the base to insert the opposite end of the rotary brush 26 to complete mounting of the brush therein.

The hood 20 and base 22 are attached together by means of a series of resilient arms 84. The arms 84, each of which include a terminal hooked end 85, are snap-fit into apertures 86. In the preferred embodiment, as illustrated in the drawing figures, three arms extend downwardly from the hood to the base, while one arm extends upwardly from the base to the hood. Removal of the hood from the base for maintenance or repair is accomplished by deforming the resilient arms 84 so that the hooked ends 85 align with the apertures 86, and thereafter pulling the hood 20 away from the base 22.

The hood 20 further provides a series of ribs (not shown) to which an elastomeric combined bumper and sealing gasket 21 is removably press-fit. The ribs include a plurality of generally vertically-oriented ribs along the lateral sides of the hood 20, and a generally horizontally-directed rib along both the front and lateral sides of the hood 20. The combined bumper and sealing gasket 21 includes a series of grooves (not shown) which received the horizontally and vertically directed ribs.

The combined bumper and gasket 21 extends downwardly past forward and lateral edges 23, 25 of the hood 20 and past forward and lateral edges 27, 29 of the base, as illustrated. In the preferred embodiment, the forward edge 23 of the hood aligns with the forward edge 27 of the base 22 while the lateral edges 25 of the hood align with the lateral edges 29 of the base 22. Preferably, the combined bumper and sealing gasket 21 includes an inwardly-directed raised rib **21*a* and a series of tab-receiving notches (not shown). The raised rib is sealingly compressed between the respective forward edges 23, 27 and lateral edges 25, 29 of the hood and base, thereby sealing the area around the brush 26 and preventing the escape of suction via the union of the forward and lateral edges of the base 22 and hood 20**.

A plurality of tabs 31 are provided by the base 22 which are positioned and designed to extend into the tab-receiving notches provided by the combined bumper and gasket 21 and thereby help retain the bumper and gasket 21 in position relative to the base 22. As best shown in FIG. 3, a separate gasket 33 is provided by the base 22 behind the brush 26. The gasket 33 is engaged and compressed by a raised sealing rib 35 provided by the hood 20 to complete the isolation of the rotatable brush 26 from the interior and exterior of the floor engaging unit 12, with the exception of the suction channel 74 and the area immediately beneath the rotatable brush 26. Preferably the gasket 33 is permanently attached by adhesives or the like to facilitate assembly, repair and maintenance of the floor engaging unit 12. Thus, the sealing of the chamber housing the rotatable brush 26 is accomplished via the cooperation of the combined bumper and gasket 21 and the permanently attached gasket 33.

The hood 20 also provides an accessory mounting door 87 to allow insertion of an accessory wand (not shown) into the floor engaging unit 12 of the vacuum cleaner 10. As shown in FIGS. 2 and 3, when the accessory door 87, is open access to the suction channel 74 via the opening 67 in the top panel. 63 is provided therethrough. Preferably, the accessory wand connector (not shown) is designed to channel suction to the accessory wand while substantially blocking suction flow from the rotary brush. Also, the accessory door 87 includes sealing means (not shown) to seal the opening 67 in the top panel 63 when an accessory is not in use.

The motor 24 provides an outwardly directed handle receiving member 88. The handle receiving member 88 facilitates mounting of the handle 14 to the motor 24, as well as the connection of power to the motor, which are main features of the present invention. The handle receiving member 88 includes an electrical plug (not shown) which allows the motor 24 to connect to electrical power via the socket of an electrical cord (not shown) carried by the handle 14. The motor does not require any further wiring, all power and wiring being accomplished and provided by the connection to the electrical cord which, in turn, is plugged into a common electrical outlet by the operator.

The motor 24 further includes an inwardly notched portion 81 which engages a releasable stop 91 when the handle 14 is in the vertical position, releasably locking the handle 14 and motor 24 in the upright or storage position. This is typically desirable when the vacuum cleaner 10 is to be used for above the floor cleaning with an accessory, as discussed previously. When it is desired to return to on the floor cleaning, or to move the handle to a non-vertical position, the pedal 95 of the releasable stop 91 is depressed, releasing the notched portion 81 of the motor 24 from engagement therewith and allowing the handle 14 to again pivot about the A—A axis.

Figure 4:
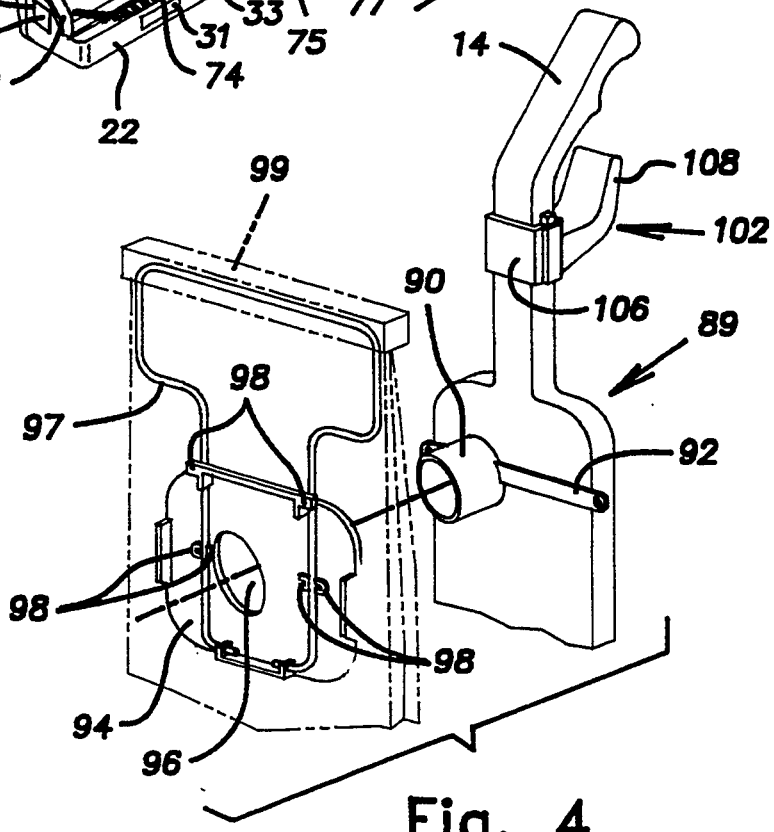
FIG. 4 is a perspective view of the handle and bag frame of the present invention, with the vacuum cleaner bag cover shown in phantom.

Upwardly spaced from the connection of the handle 14 to the motor 24, the handle provides a vacuum bag mounting means 89. The vacuum bag mounting means includes a cylindrical projection 90 and a fastener retention means 92. The cylindrical projection 90 extends through an aperture in the vacuum bag cover 16 and into a baseplate 94. As shown best in FIG. 4, the baseplate 94, which is sewn or otherwise permanently attached to the rear interior surface of the vacuum bag cover 16, includes an offset opening 96 for the receipt of the cylindrical projection 90. The baseplate 94 is attached to a vacuum bag support frame 97 by means of a plurality of resilient projections 98. The support frame 97, which is preferably formed of wire, engages the baseplate 94 and extends around the upper inside perimeter of the vacuum bag cover 16. Along the upper external edge of the vacuum bag cover, a bag cover top member 99 is provided which snap fits over the top of the cover 16 and the frame 97, holding the frame and bag together.

Upwardly spaced from the cylindrical projection is provided a slidably fit hose hook 102 which supports the hose (not shown) of the vacuum cleaner 10 during storage thereof. The hose hook 102 has a central circular portion 106 which is provided with an aperture slightly smaller than the diameter of the handle 14, but which is resiliently stretchable, to allow slidable mounting of the hose hook 102 to the handle 14. Adjacent the central section is an upstanding hook portion 108 which receives the hose and provides vertical support therefor. The handle 14 has a projection 110 integral therewith which defines a stop, limiting the downward progress of the hose hook 102 along the handle.

The foregoing description of the invention is illustrative of the preferred embodiment presently contemplated by the inventor, and is not to be construed in a limitative manner. Rather, since the invention is capable of being performed in several manners equivalent to the ones specifically described herein, the scope of the invention is only to be defined by the claims appended hereto.

What is claimed is:

1. An upright vacuum cleaner, comprising a floor engaging unit, said floor engaging unit being supported above the floor by a plurality of floor engaging wheels and having a rotary brush mounted thereto, said floor engaging unit comprising a base having an open mouth adapted to face a surface to be cleaned, a hood, and a combined bumper and sealing gasket means, said combined bumper and sealing gasket means including a sealing rib which sealingly extends between said base and hood, and a bumper portion which covers at least a portion of an exterior surface of said hood and at least a portion of an exterior surface of said base, said combined bumper and sealing gasket means at least partially sealingly isolating said rotary brush from an exterior of said floor engaging unit, said hood further comprising a raised sealing rib, said raised sealing rib engaging a gasket provided by the base to at least partially isolate the rotatable brush from an interior of the floor engaging unit.

2. An upright vacuum cleaner according to claim 1, wherein the combined bumper and sealing gasket and the raised sealing rib and gasket cooperate to isolate the rotary brush from the interior and exterior of the floor engaging unit, with the exception of a suction flow path from said open mouth, said suction flow path enabling dirt to be communicated from an area adjacent the brush to a removable dirt receptacle carried by the vacuum cleaner.

* * * * *